United States Patent [19]

Hofmann et al.

[11] Patent Number: 4,508,275

[45] Date of Patent: Apr. 2, 1985

[54] FUEL INJECTION NOZZLE FOR INTERNAL COMBUSTION ENGINES

[75] Inventors: Karl Hofmann, Remseck; Werner Banzhaf, Sindelfingen, both of Fed. Rep. of Germany

[73] Assignee: Robert Bosch GmbH, Stuttgart, Fed. Rep. of Germany

[21] Appl. No.: 133,724

[22] Filed: Mar. 25, 1980

[51] Int. Cl.[3] ..... F02M 61/10

[52] U.S. Cl. ..... 239/533.3

[58] Field of Search ..... 239/533.2, 533.3, 533.4, 239/533.5, 533.6, 533.7, 533.8, 533.9, 533.10, 533.11, 533.12

[56] References Cited

U.S. PATENT DOCUMENTS 2,235,365 3/1941 Grumbt ..... 239/562

3,612,407 10/1971 Hano ..... 239/533.12 X

*Primary Examiner*—Andres Kashnikow

*Attorney, Agent, or Firm*—Edwin E. Greigg

[57] ABSTRACT

A fuel injection nozzle for internal combustion engines having an inwardly opening valve needle is proposed, this valve needle has a channel comprising two parts, the first of which located in the upstream direction, has a smaller measurement in cross section in one dimension than the diameter of the communicating or downstream part which has the exact injection diameter. As a result, the entry of shavings into the downstream part and the consequent alteration in injection are avoided.

4 Claims, 4 Drawing Figures

Fig. 1
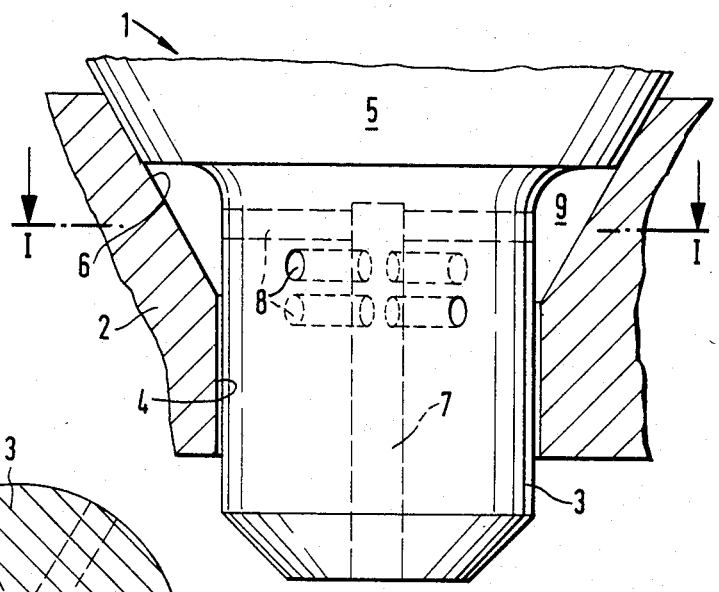
Fig. 2
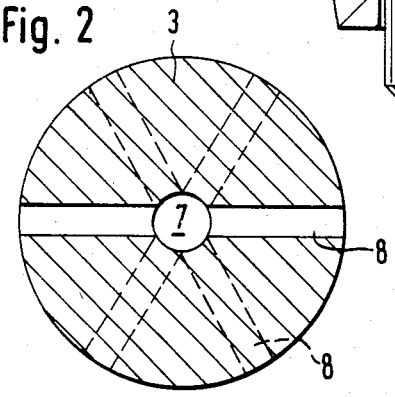
Fig. 3
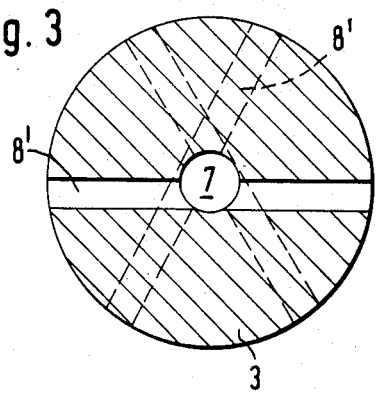
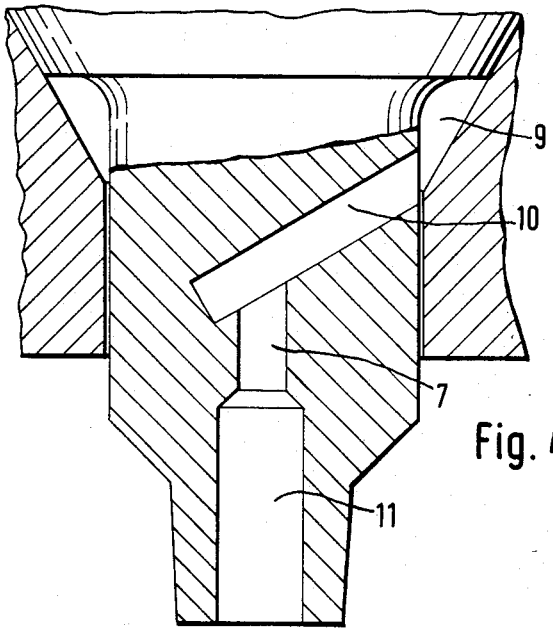
Fig. 4

FUEL INJECTION NOZZLE FOR INTERNAL COMBUSTION ENGINES

BACKGROUND OF THE INVENTION

The invention relates to a fuel injection nozzle for internal combustion engines having an inwardly opening valve needle and a head which protrudes through an injection port. The nozzle typically has an annular chamber between the valve needle and nozzle body which is downstream of the valve seat. Within the valve needle is a longitudinal blind bore and connecting channels which extend transverse to the longitudinal bore to connect the longitudinal bore and the annular chamber. In known fuel injection nozzles of this kind, a bore whose diameter is larger than the diameter of the longitudinal blind bore acts as the connection between the injection port and a chamber located between the valve needle and the nozzle body. As a result, unnecessary influences on the fuel throttling which may already be present in this connection are precluded. The disadvantage of these known fuel injection nozzles is that in the flowthrough area of the nozzle, or coming from the injection pump, floating shavings can get into the connection and from there into the longitudinal bore, which either blocks the longitudinal bore or alters the precision of injection.

OBJECT AND SUMMARY OF THE INVENTION

A fuel injection nozzle is provided which is similar in basic structure to the nozzles described above, except that one dimension of the channel connecting the annular chamber and the longitudinal bore is smaller than the diameter of the longitudinal bore. Yet, the total cross sectional area of the connecting channel is greater than the cross sectional area of the longitudinal bore. Thus, the present invention has the advantage over the prior art that the connection acts as a filter, so that the shavings cannot get into the longitudinal bore and plut it; and when the valve needle is fully opened, that is, when the head of the valve needle emerges out of the main injection port, the shavings are thereby flushed out. Advantageous embodiments are disclosed in the dependent claims.

An object of the present invention is to provide a valve needle having a longitudinal bore and transverse bores which have individual cross sectional areas that are smaller than the longitudinal cross sectional area, such that the transverse bores filter foreign matter from fuel flowing through the valve needle.

A further object is to provide the transverse bores with a total cross section which is greater than the longitudinal bore cross section to prevent throttling of fuel to the longitudinal bore.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows the first exemplary embodiment, while FIGS. 2 and 3 are variants of FIG. 1 as viewed through the head of the valve needle along the line I—I of FIG. 1; and FIG. 4 shows the second exemplary embodiment of the invention.

DESCRIPTION OF THE PREFERRED EMBODIMENTS

A valve needle 1 is disposed in a nozzle body 2 in axially displaceable fashion, with the head 3 of the valve needle 1 arranged to protrude into a main injection port 4. The valve needle 1 has a conical section 5, which cooperates with a valve seat 6. A central injection port 7 is disposed in the head 3 of the valve needle 5, which is connected via transverse bores 8 with a chamber 9, which is formed between the valve needle 1 and the nozzle body 2. The individual cross section of these transverse bores 8 is smaller than the cross section of the central injection port 7, as a result of which shavings that float along with the fuel are prevented from sticking in the injection port 7.

The total cross section of the transverse bores 8 must be greater than the cross section of the injection port 7, so as to avoid an undesirable throttling of the fuel toward the injection port 7, which furthermore would be difficult to influence, and which could otherwise occur in the connections embodied by the transverse bores 8 between the chamber 9 and the injection port 7. In order to assure that this is done, there is an appropriate number of transverse bores 8; in the illustrated exemplary embodiment, there are three. In order to assure a satisfactory connection of the transverse bores 8 with the injection port 7, the transverse bores 8 are disposed at various levels relative to the injection port 7, and are also located at an angular displacement relative to one another.

In the variant embodiment shown in FIG. 2, the axes of the transverse bores intersect the axis of the injection port 7 directly. In the variant shown in FIG. 3, in contrast, the axes of the transverse bores 8' are disposed in such a manner that they are shifted with respect to the axis of the injection port 7.

In the second exemplary embodiment shown in FIG. 4, a angularly disposed bore 10 acts as the connection between the chamber 9 and the injection port 7. The width of this particular bore 10 is smaller than the diameter of the injection port 7. The injection port 7 has an enlarged section 11 which extends toward the discharge side thereof. Also, it is to be understood, even though it is not shown in FIG. 4, that the channel or bore 10 can have a rectangular cross section or can be provided in the form of an elongated slit which can merge into the blind bore 7.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having:

a nozzle body having an injection port;

an inwardly opening valve needle;

a valve seat on which the valve needle rests;

a valve needle head arranged to protrude through the injection port; and an annular chamber defined by the valve needle and the nozzle body downstream of the valve seat; wherein the valve needle includes:

a longitudinal bore which opens to the valve needle head;

at least two connecting channels which branch from the longitudinal bore to the annular chamber, and which extend substantially transverse to the valve needle longitudinal axis, wherein the total cross sectional area of the at least two connecting channels is greater than the cross sectional area of the longitudinal bore to prevent throttling of fuel toward the injection port, and wherein at least one dimension of each of the at least two connecting channels is less than the longitudinal bore diameter to prevent foreign matter from entering the longitudinal bore from the annular chamber.

2. A fuel injection nozzle in accordance with claim 1, characterized in that a plurality of transverse bores of smaller cross-sectional area than the longitudinal bore comprise said at least two connecting channels.

3. A fuel injection nozzle in accordance with claim 2, characterized in that said transverse bores have axes which are offset with respect to that of the longitudinal bore and said transverse bores are arranged to intersect the longitudinal bore.

4. A fuel injection nozzle in accordance with claim 2, characterized in that said valve needle head has a height and said transverse bores are disposed at least in part displaced relative to one another in said height.

* * * * *